US009844110B1

(12) United States Patent
Tsai et al.

(10) Patent No.: US 9,844,110 B1
(45) Date of Patent: Dec. 12, 2017

(54) CURRENT ADJUSTMENT APPARATUS FOR LED LIGHTING FIXTURE

(71) Applicant: Chicony Power Technology Co., Ltd., New Taipei (TW)

(72) Inventors: Chao-Wei Tsai, New Taipei (TW); Chih-Hsien Chiang, New Taipei (TW); Sung-Wei Wu, New Taipei (TW); Chih-Hung Lin, New Taipei (TW); Hung-Ta Shih, New Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 0 days.

(21) Appl. No.: 15/431,216

(22) Filed: Feb. 13, 2017

(30) Foreign Application Priority Data

Dec. 2, 2016 (TW) ..... 105140014 A

(51) Int. Cl.
*H05B 37/02* (2006.01)
*H05B 33/08* (2006.01)

(52) U.S. Cl.
CPC ..... *H05B 33/0842* (2013.01); *H05B 37/0254* (2013.01); *H05B 33/0833* (2013.01); *H05B 33/0845* (2013.01)

(58) Field of Classification Search
CPC ..... H05B 33/0842; H05B 33/0833; H05B 33/0845
USPC ..... 315/185 R, 291, 292, 302
See application file for complete search history.

(56) References Cited

U.S. PATENT DOCUMENTS

2013/0229119 A1* 9/2013 Korobov ..... H05B 33/0818 315/185 R
2013/0229124 A1* 9/2013 Livschitz ..... H05B 37/02 315/201
2014/0125244 A1* 5/2014 Nuhfer ..... H05B 33/0815 315/219
2014/0293038 A1* 10/2014 Delmonico ..... H04N 5/2256 348/82
2015/0351191 A1* 12/2015 Pope ..... H05B 33/0863 315/294

* cited by examiner

*Primary Examiner* — Thuy Vinh Tran
(74) *Attorney, Agent, or Firm* — Muncy, Geissler, Olds & Lowe, P.C.

(57) ABSTRACT

The current adjustment apparatus includes a communication interface, a current generating module, and a current adjustment module. The current generating module includes a microprocessor, a memory for storing a current setting parameter, and a current generating unit; the memory and the current generating unit are electrically connected to the microprocessor. When the current adjustment module is not physically connected to the current generating module, the microprocessor makes the current generating unit generate a driving current in response to the current setting parameter; when the current adjustment module is physically connected to the current generating module via the communication interface, the microprocessor makes the current generating unit generate the driving current in accordance with a setting signal from the current adjustment module, and the microprocessor further overwrites the current setting parameter in accordance with the setting signal when receives a writing signal.

14 Claims, 7 Drawing Sheets

CURRENT ADJUSTMENT APPARATUS FOR LED LIGHTING FIXTURE

BACKGROUND

Technical Field

The present disclosure relates to a driving apparatus. More particularly, the present disclosure relates to a driving current adjustment apparatus for LED lighting fixture.

Description of Related Art

A light emitting diode (LED) is a kind of semiconductor device, which exploits the property of direct-bandgap semiconductor material to convert electric energy into light energy efficiently and has advantages of long lifetime, high stability, and low power consumption, and the LED is widely used in indoor and outdoor lighting and developed to replace the traditional non-directivity fluorescent lamp, gas discharge lamp (such as HID lamp), and incandescent lamp.

The LED-based lighting fixture (hereafter "the LED lighting fixture") may be driven by an LED driver which may convert input power, for example, utility alternative current (AC) power, into required form for use by the LED lighting fixture. Commonly, the LED lighting fixtures with different illuminance require different power specifications, hence a manufacturer have to manufacture a large number of different LED drivers just to meet the requirements of different power specifications; however, it consumes lots of money and elongates the development time.

SUMMARY

In view of the above, this disclosure discloses a current adjustment apparatus for LED lighting fixture, capable of adjusting current in correspondence to the required power specification to lower development cost and time.

According to one aspect of the present disclosure, the current adjustment apparatus for LED lighting fixture includes a communication interface, a current generating module, and a current adjustment module; the current generating module includes a microprocessor, a memory, and a current generating unit; the memory is electrically connected to the microprocessor and configured to store a current setting parameter; the current generating unit is electrically connected to the microprocessor and configured to generate a driving current for driving the LED lighting fixture. The current adjustment module is configured to generate a setting signal and a writing signal. The microprocessor makes the current generating unit generate the driving current with particular level in response to the current setting parameter when the current adjustment module is not physically connected to the current generating module; the microprocessor makes the current generating unit generate the driving current with another particular level in accordance with the setting signal when the current generating module is physically connected to the current adjustment module and the microprocessor receives the setting signal via the communication interface; and the microprocessor further overwrites the current setting parameter in accordance with the setting signal when the microprocessor receives the writing signal via the communication interface.

In the present disclosure, the current adjustment module may adjust the driving current generated by the current generating module, hence the current adjustment apparatus for the LED lighting fixture may be widely used in LED lighting fixtures with different power specifications, and has advantages of lowering the development time and cost.

BRIEF DESCRIPTION OF DRAWING

Embodiment of the present disclosure will be described by way of example embodiment, but not limitations, illustrated in the accompanying drawings in which like references denote similar elements, and in which.

DETAILED DESCRIPTION

Figure 1:
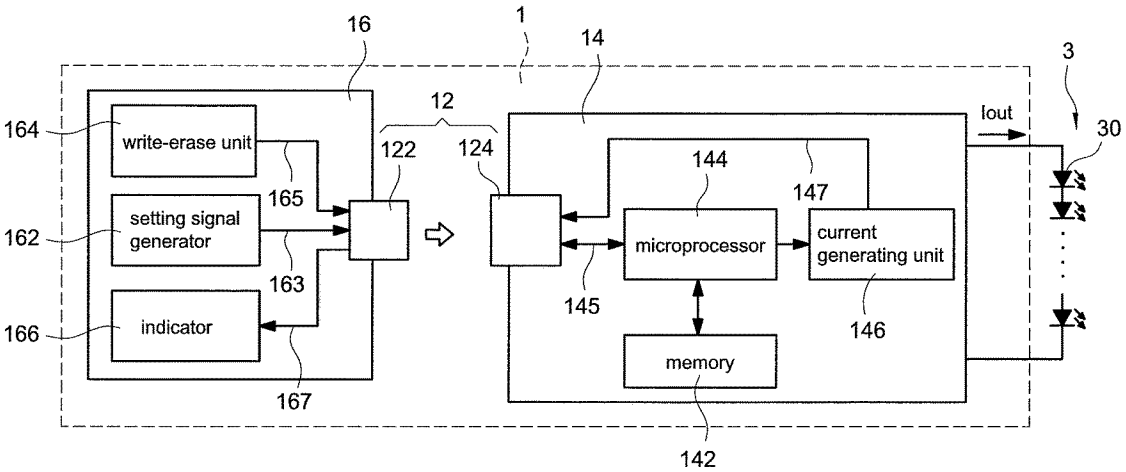
FIG. 1 is a circuit block diagram of a current adjustment apparatus for light emitting diode (LED) lighting fixture according to a 1st embodiment of the present disclosure.

Reference is made to FIG. 1, which is a circuit block diagram of a current adjustment apparatus for light emitting diode (LED) lighting fixture according to a 1st embodiment of the present disclosure. In FIG. 1, the current adjustment apparatus for LED lighting fixture 1 is configured to drive an LED lighting fixture 3 including one or more white and/or multicolored LEDs 30 with specific parameters.

The current adjustment apparatus for LED lighting fixture 1 includes a communication interface 12, a current generating module 14, and a current adjustment module 16, and the current generating module 14 is interconnected with the current adjustment module 16 by the communication interface 12 consolidating data transmissions and power delivery; the current generating module 14 and the current adjustment module 16 may be communicated with each other via the communication interface 12.

The communication interface 12 is a wire-based interface and may be a universal serial bus (USB) interface. In addition, the communication interface 12 includes a connector plug 122 and a mating port 124 configured to mate with the connector plug 122, and the mating of the connector plug 122 and the mating port 124 supports communications via a USB interface. In FIG. 1, the connector plug 122 is arranged on the current adjustment module 16, and the mating port 124 is arranged on the current generating module 14, the mating of the connector plug 122 and the mating port 124 provides a communication between the current adjustment module 16 and the current generating module 14. As used herein, mating the connector plug 122 with the mating port 124 refers to providing a physical connection (or called mechanical connection).

The current generating module 14 includes a memory 142, a microprocessor 144, and a current generating unit 146; the memory 142 is configured to store a current setting parameter and may be, for example, an electrically-erasable programmable read-only memory (EEPROM) or flash memory.

The microprocessor 144 is electrically connected to the memory 142 and the current generating unit 146; the microprocessor 144 is further electrically connected to the mating port 124 via the path 145. The path 145 may represent one or more components, which may include (processing) components that convey electrical signals between the microprocessor 144 and the mating port 124. The microprocessor 144 is, for example, a pulse width modulator configured to generate a pulse width modulating (PWM) signal for the current generating unit 146.

The current generating unit 146 is configured to generate a driving current Tout in response to the PWM signal sent from the microprocessor 144. The LED lighting fixture 3 is connected to the current generating unit 146 and receives the driving current Iout generated by the current generating unit 146.

Figure 2:
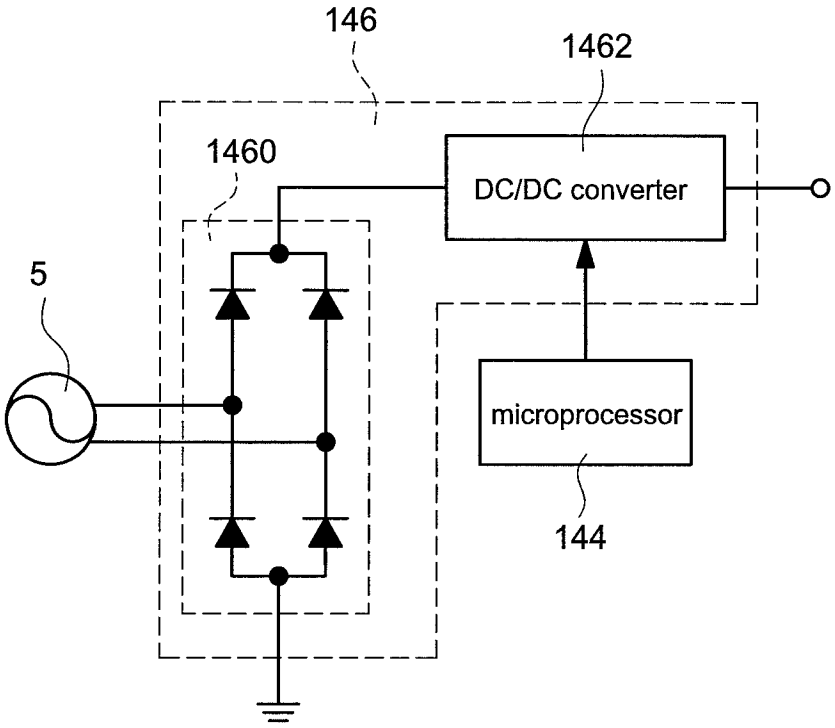
FIG. 2 is a circuit block diagram of a current generating unit of the current adjustment apparatus for LED lighting fixture according to the 1st embodiment of the present disclosure.

Reference is made to FIG. 2, which is a circuit block diagram of the current generating unit according to the 1st embodiment of the present disclosure. In FIG. 2, the current generating unit 146 includes an alternating current (AC)/direct current (DC) converter 1460 and a DC/DC converter 1462; the AC/DC converter 1460 is electrically connected to a power supply terminal 5 for receiving an AC power from the power supply terminal 5 and convert the AC power into a DC power. The DC/DC converter 1462 electrically connected to the AC/DC converter 1460 and the microprocessor 144 is configured to step up/step down the DC power and adjust the level of the driving current Tout in accordance with a duty cycle of the PWM signal generated by the microprocessor 144.

With referring again to FIG. 1; when the current generating module 14 is not physically connected to the current modulating module 16, the microprocessor 144 generates the PWM signal with particular duty cycle in accordance with the current setting parameter stored in the memory 142, and the current generating unit 146 then outputs the driving current Tout with particular level in response to the duty cycle of the PWM signal.

The current adjustment module 16 includes a setting signal generator 162 and a write-erase unit 164; the setting signal generator 162 is configured to generate a setting signal. The setting signal generator 162 may be an active component (such as microprocessor or IC) or a passive component (such as one or more resistors or Dip switches), and may generate, for example, one or more DC voltage signals, DC current signals, PWM signals, digital logic signals or any other form of electrical signals. The setting signal generator 162 may be electrically connected to the connector plug 122 via the path 163; the path 163 may represent one or more components, which may include processing components that convey electrical signals between the setting signal generator 162 and the connector plug 122.

The write-erase unit 164 may generate a writing signal or an erase signal in accordance with a trigger instruction. The write-erase unit 164 is electrically connected to the connector plug 122 via the path 165; the path 165 may represent one or more components, which may include processing components that convey electrical signals between the write-erase unit 164 and the connector plug 122.

When the current adjustment module 16 is physically connected to the current generating module 14 via the connected connector plug 122 and the mating port 124, the microprocessor 144 receives the setting signal from the setting signal generator 162 and modulates the duty cycle of the PWM signal in accordance with the setting signal, thus the level of the driving current Tout outputted from the current generating unit 146 is adjusted.

It should be noted that the microprocessor 144 may preferentially modulate the duty cycle of the PWM signal in accordance with the setting signal when the current adjustment module 16 and the current generating module 14 are physically connected and communicated with each other via the USB interface; in the other words, the microprocessor 144 may be no longer modulate the duty cycle of the PWM signal in accordance with the current setting parameter stored in the memory 142 when the current modulating module 16 is physically connected to the current generating module 14.

Additionally, the microprocessor 144 may receive a writing signal provided by the write-erase unit 164 after the current adjustment module 16 is physically connected to the current generating module 14 and communicated with the current generating module 14 via the USB interface; after the microprocessor 144 receives the writing signal, it overwrites the current setting parameter stored in the memory 142 in accordance with the setting signal to produce a new current setting parameter.

As mentioned previously the microprocessor 144 may modulate the duty cycle of the PWM signal in response to the current setting parameter when the current generating module 14 is not physically connected to the current adjustment module 16; thus after the microprocessor 144 overwrites the current setting parameter in accordance with the setting signal, even if the current adjustment module 16 is separated from the current generating module 14, the duty cycle of the PWM signal generated by the microprocessor 144 is the same as that of the PWM signal while the current adjustment module 16 is physically connected to the current generating module 14. To put it differently, after the microprocessor 144 successfully overwrites the current setting parameter in accordance with the setting signal, the level of the driving current Tout will not be changed when the current generating module 14 and the current adjustment module 16 are separated.

Furthermore, the microprocessor 144 may receive an erase signal provided by the write-erase unit 164 while the current adjustment module 16 is physically connected to the current generating module 14 and communicated with the current generating module 14 via the USB interface. When the current adjustment module 16 is physically connected to the current generating module 14, the microprocessor 144 modulates the duty cycle of the PWM signal in accordance with the setting signal from the current adjustment module 16 to adjust the level of the driving current Tout; in the meanwhile, the microprocessor 144 further erases the current setting parameter stored in the memory 142 to reset to a factory default. Thereafter, when the current adjustment module 16 is separated from the current generating module 14, the microprocessor 144 will modulate the duty cycle of the PWM signal in response to the factory default to adjust the level of the driving current Tout. It should be noted that the maximum level of the driving current Tout is occurred when current setting parameter is reset to the factory default.

Figure 3:
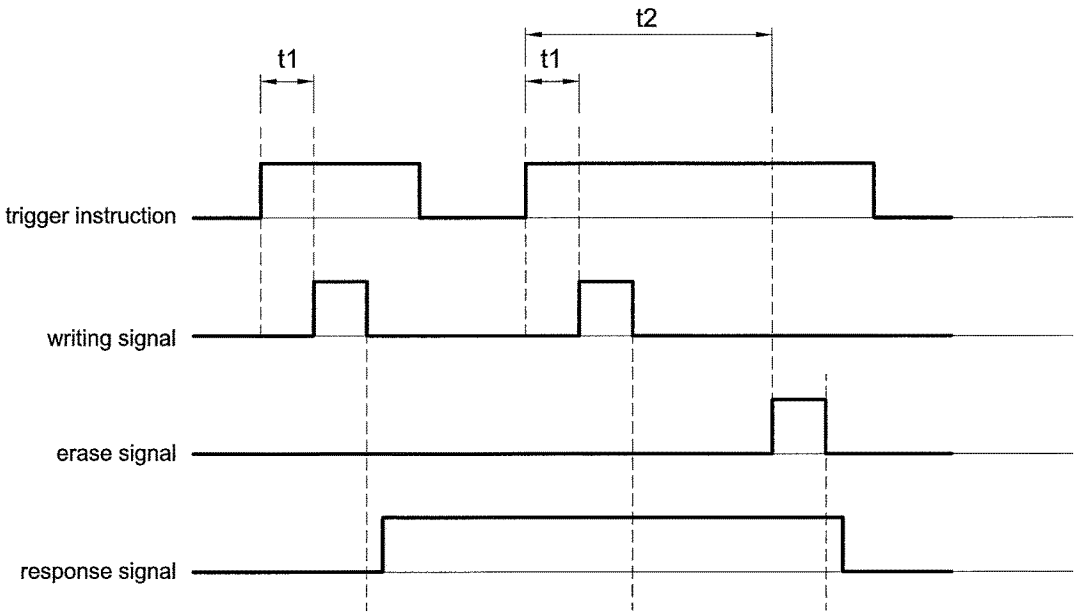
FIG. 3 is a timing diagram of a current adjustment module of the current adjustment apparatus for LED lighting fixture according to the 1st embodiment of the present disclosure.

In the present disclosure, the write-erase unit 164 is, for example, a normally open pressed switch. The write-erase unit 164 is configured to generate the writing signal or the erase signal in accordance with duration of the trigger instruction. Reference is made to FIG. 3; when the duration of the trigger instruction continues for a first predetermined time length t1 (such as 1 second), a writing signal is generated; when the duration of the trigger instruction exceeds a second predetermined time length t2 (such as 4 seconds), the erase signal is generated; wherein the second predetermined time length t2 is longer than the first predetermined time length t1. In the other words, the write-erase unit 164 may generate the writing signal when the duration of the trigger instruction is longer than the first predetermined time length t1 but less than the second predetermined time length t2. The first predetermined time length t1 is used for preventing user from triggering the writing signal inadvertently.

With referring again to FIG. 1; the current adjustment module 16 may further include an indicator 166 electrically connected to the connector plug 122 via the path 167. The indicator 166 is, for example, an LED. The path 167 may represent one or more components, which may include processing components that convey an electrical signal between the indicator 166 and the connector plug 122. The microprocessor 144 may generates a (high level) response signal after receiving the writing signal and successfully overwriting the current setting parameter, as shown in FIG. 3. The (high level) response signal is transmitted to the current adjusting module 16 from the microprocessor 144 via the communication interface 12 and indicated by the indicator 166, thus user may know that the current setting parameter is successfully overwritten in accordance with the setting signal. Besides, the microprocessor 144 may stop generating the response signal or generate a low level response signal (as shown in FIG. 3) after receiving the erase signal and successfully resetting the current setting parameter to the factory default; thereafter, the indicator 166 may stop indicating, thus user may know that the current setting parameter is successfully reset to the factory default.

It should be noted that the microprocessor 144 may generate the response signal (with high level) when the current setting parameter stored in the memory 142 is not reset to the factory default. As mentioned previously the microprocessor 144 may generate the (high level) response signal after the current setting parameter is overwritten in accordance with the setting signal to make the indicator 166 to indicate the response signal; that is to say, the microprocessor 144 may generate the (high level) response signal to drive the indicator 166 to indicate the response signal before it receive the erase signal and reset the current setting parameter to the factory default. That is to say, the microprocessor 144 may generate the (high level) response signal to drive the indicator 166 to indicate the response signal and inform user that the current setting parameter is not reset to the factory default even if the current adjustment module 16 is again physically reconnected to the current generating module 14 after being separated from it. Besides, the current adjustment module 16 may overwrite the current setting parameter stored in the memory 142 in accordance with the setting signal or reset the current setting parameter to the factory default while the current generating module 14 being powered on. When the current generating module 14 is under powered on condition, it may generate the driving current Tout for the LED lighting fixture 3 in response to the current setting parameter when it is not physically connected to the current adjustment module 16.

The current generating unit 146 may electrically connected to the mating port 124 via the path 147, and when the current adjustment module 16 is physically connected to the current generating module 14 via the communication interface 12, the current generating unit 146 supplies an operation power to the current adjustment module 16 using USB power delivery protocol. Thereafter the write-erase unit 164 of the current adjustment module 16 may generate the writing signal or the erase signal in accordance with the duration of the trigger instruction, and the indicator 166 may indicate the response signal from the microprocessor 144. The path 147 may represent one or more components, which may include processing components that convey electrical signals between the current generating unit 146 and the mating port 124.

Moreover, the current adjustment module 16 may overwrite the current setting parameter stored in the memory 142 in accordance with the setting signal or reset the current setting parameter to the factory default when the current generating module 14 being powered off. When the current generating module 14 is under powered off condition, the current generating unit 146 cannot supply the operation power to the current adjustment module 16 via the path 147 (namely the path 147 may be not existed in the current generating module 14) and generate the driving current Tout for the LED lighting fixture 3. Accordingly, a power supply 18 (as shown in FIG. 4) may be provided to supply operation power to the current adjustment module 16 and the current generating module 14.

Figure 4:
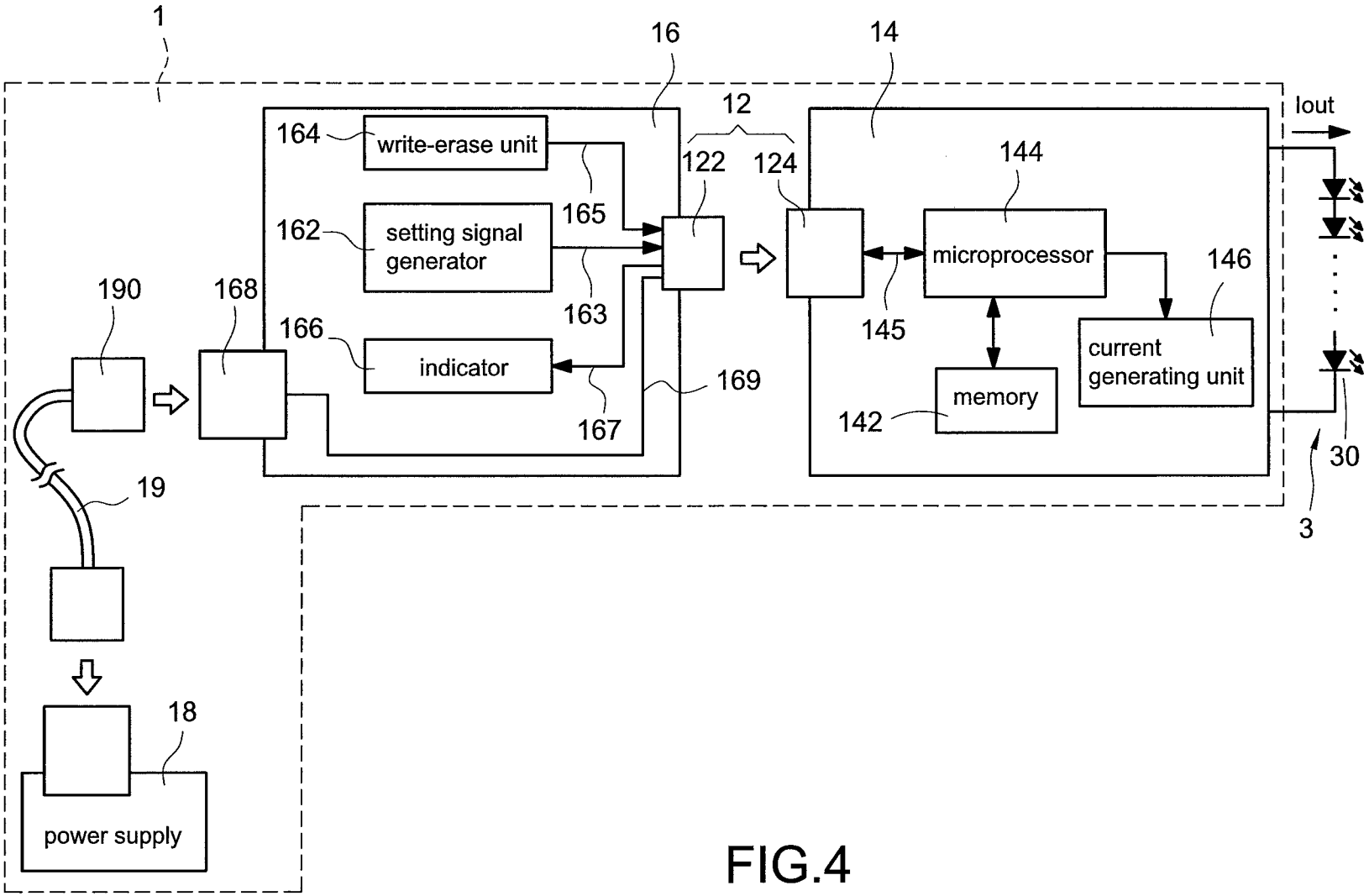
FIG. 4 is a circuit block diagram of a current adjustment apparatus for LED lighting fixture according to a 2nd embodiment of the present disclosure.

FIG. 4 is a circuit block diagram of a current adjustment apparatus for LED lighting fixture according to a 2nd embodiment of the present disclosure. In FIG. 4, the power supply 18 may supply DC operation power for processing an off-line burning procedure. The power supply 18 may be physically connected to the current adjustment module 16 by mating a plug connector 190 of a cable assembly 19 connected to the power supply 18 with a mating port 168 of the current adjustment module 16. When the plug connector 190 is mated with the mating port 168, the power supply 18 may supply the DC operation power to the current adjustment module 16 using USB power delivery protocol.

In addition, the mating port 168 may be electrically connected to the connector plug 122 via the path 169; therefore the power supply 18 may further conduct the DC operation power to the current generating module 14 using USB power delivery protocol to power the memory 142 and the microprocessor 144. The path 169 may represent one or more components, which may include processing components that convey electrical signals between the mating port 168 and the connector plug 122. Therefore, the write-erase unit 164 of the current adjustment module 16 may generate the writing signal or the erase signal in accordance with the duration of the trigger instruction, the microprocessor 144 may overwrite the current setting parameter stored in the memory 142 in accordance with the setting signal or reset the current setting parameter to the factory default in accordance with the erase signal, and the indicator 166 may indicate the response signal from the microprocessor 144.

Figure 5:
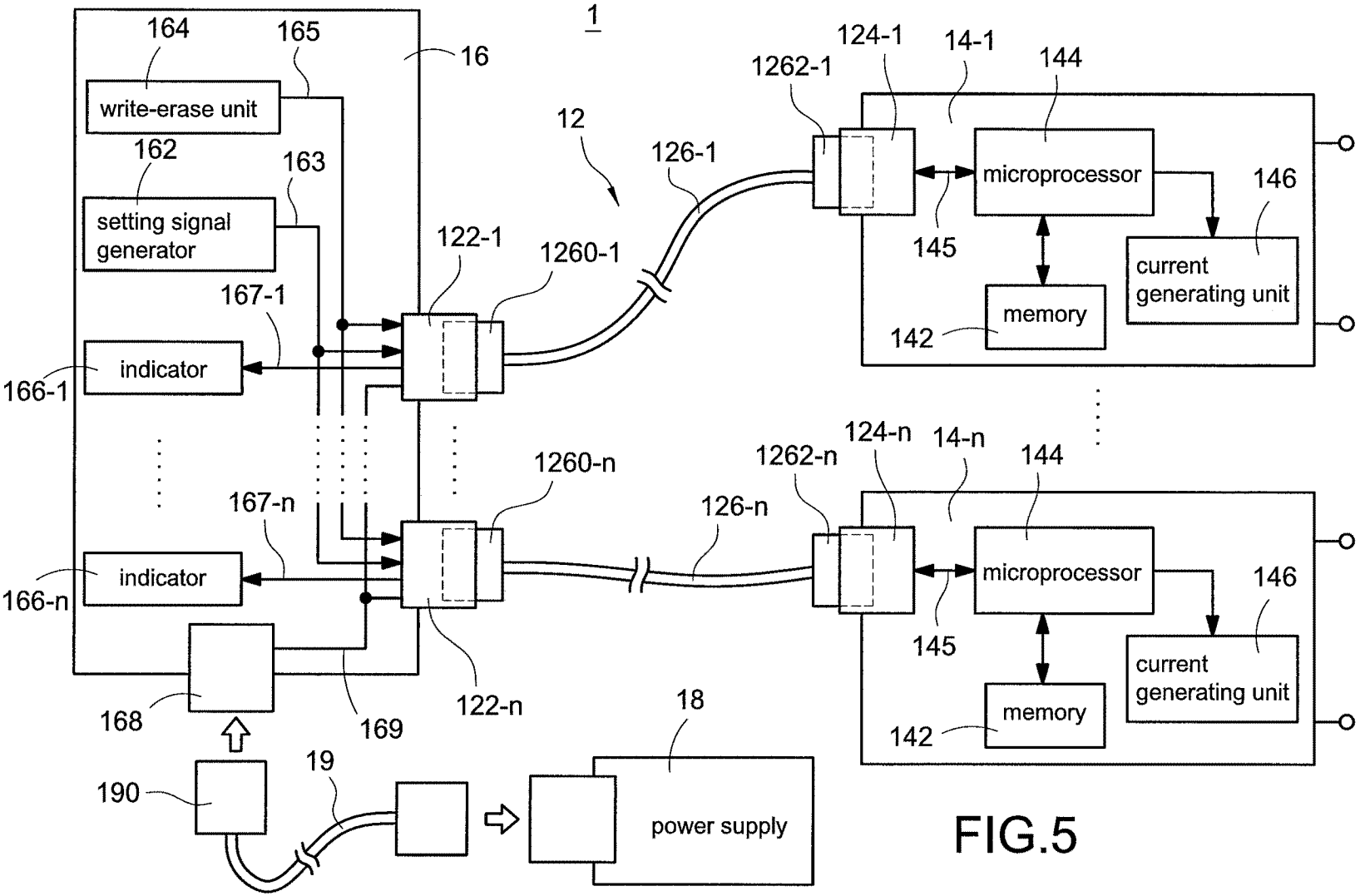
FIG. 5 is a circuit block diagram of a current adjustment apparatus for LED lighting fixture according to a 3rd embodiment of the present disclosure.

Reference is made to FIG. 5, which is a circuit block diagram of a current adjustment apparatus for LED lighting fixture according to a 3rd embodiment of the present disclosure. In FIG. 5, the current adjustment apparatus for LED lighting fixture 1 includes a communication interface 12, a plurality of current generating modules 14-1~**14-*n*, and a current adjustment module 16; wherein n is an integral. The scheme of each of the current generating modules 14-1~14-*n* is the same as the current generating module 14 shown in FIG. 4 mentioned above and is not repeated here for brevity. The current adjustment module 16 shown in FIG. 5 may overwrite the current setting parameter(s) stored in the memories 142 of the current generating modules 14-1~14-*n* in accordance with the setting signal or reset the current setting parameter(s) stored in the memories 142 of the current generating modules 14-1~14-*n*** to the factory default in accordance with the erase signal.

The current generating modules **14-1~14-*n* are physically connected to the current adjustment module 16 via the communication interface 12, which allows data and power delivering between the current generating modules 14-1~14-*n* and the current adjustment module 16. The communication interface 12 is a wire-based interface and may be a universal serial bus (USB) interface. In FIG. 5, the communication interface 12 includes a plurality of mating ports 122-1~122-*n* respectively arranged on the current adjustment module 16, a plurality of mating ports 124-1~124-*n* respectively arranged on the current generating modules 14-1~14-*n*, and a plurality of cables 126-1~426-*n***.

The mating ports **122-1~122-*n* are respectively mated with connector plugs 1260-1~1260-*n* arranged at one end of the cables 126-1~126-*n*, and the mating ports 124-1~124-*n* are respectively mated with connector plugs 1262-1~1262-*n* arranged at the other end of the cables 126-1~126-*n*; the mating of the mating ports 122-1~122-*n* and the connector plugs 1260-1~1260-*n*, and the mating of the connector plugs 1262-1~1262-*n* and the mating ports 124-1~124-*n*** support communications via a USB interface.

The current adjustment module 16 includes a setting signal generator 162, a write-erase unit 164, and a plurality of indicators **166-1~166-*n*. The setting signal generator 162 is configured to generate a setting signal and electrically connected to the mating ports 122-1~122-*n* via the path 163. The write-erase unit 164 is configured to generate a writing signal or an erase signal in accordance with duration of the trigger instruction. The write-erase unit 164 is electrically connected to the mating ports 122-1~422-*n* via the path 165. The indicators 166-1~166-*n* are electrically connected to the mating ports 122-1~122-*n* via the paths 167-1~167-*n*, respectively. An amount of the indicators 166-1~166-*n* is the same as an amount of the current generating modules 14-1~14-*n*, and the indicators 166-1~166-*n* are configured to indicate the response signal and inform user that the current setting parameter(s) stored in the memories 142 are overwritten in accordance with the setting signal from the current adjustment module 16** or the current setting parameter(s) are reset to the factory default(s) in accordance with the erase signal.

The microprocessors 144 may generate the (high level) response signal after receiving the writing signal and successfully overwriting the current setting parameter(s) in accordance with the setting signal; the (high level) response signal is then transmitted to the current adjustment module 16 via the communication interface 12 for driving the corresponding indicators **166-1~166-*n* to indicate the response signal and inform user that the current setting parameter(s) stored in the memories 142 are overwritten in accordance with the setting signal. Besides, after the microprocessors 144 of the current generating modules 14-1~14-*n* receive the erase signal from the current adjustment module 16 and successfully reset the current setting parameter(s) to the factory default, the microprocessors 144 may stop generating the response signal or generate the response signal with low level to make the corresponding indicators 166-1~166-*n*** stop indicating the response signal, thus user may know that the current setting parameter(s) are reset to the factory default.

The current adjustment apparatus 1 shown in FIG. 5 may further includes a power supply 18 physically connected to the current adjustment module 16 via a connector plug 190 of a cable assembly 19 and the mating port 168 of the current adjustment module 16. When the connector plug 190 is mated with the mating port 168, the power supply 18 may supply an operation power to the current adjustment module 16 using USB power delivery protocol.

The mating port 168 may further electrically connected to the mating ports **122-1~122-*n* via the path 169, thus the operation power may be supplied to the current generating modules 14-1~14-*n* using USB power delivery protocol for powering the memories 142 and the microprocessors 144. Thereafter, the write-erase unit 164 of the current adjustment module 16 may generate the writing signal or the erase signal in accordance with the duration of the trigger instruction to make the microprocessor 144 overwrite the current setting parameter(s) stored in the memories 142 in accordance with the setting signal or reset the current setting parameter(s) to the factory default in accordance with the erase signal, and the indicators 166-1~166-*n* may indicate the response signal from corresponding microprocessor(s) 144**.

Figure 6:
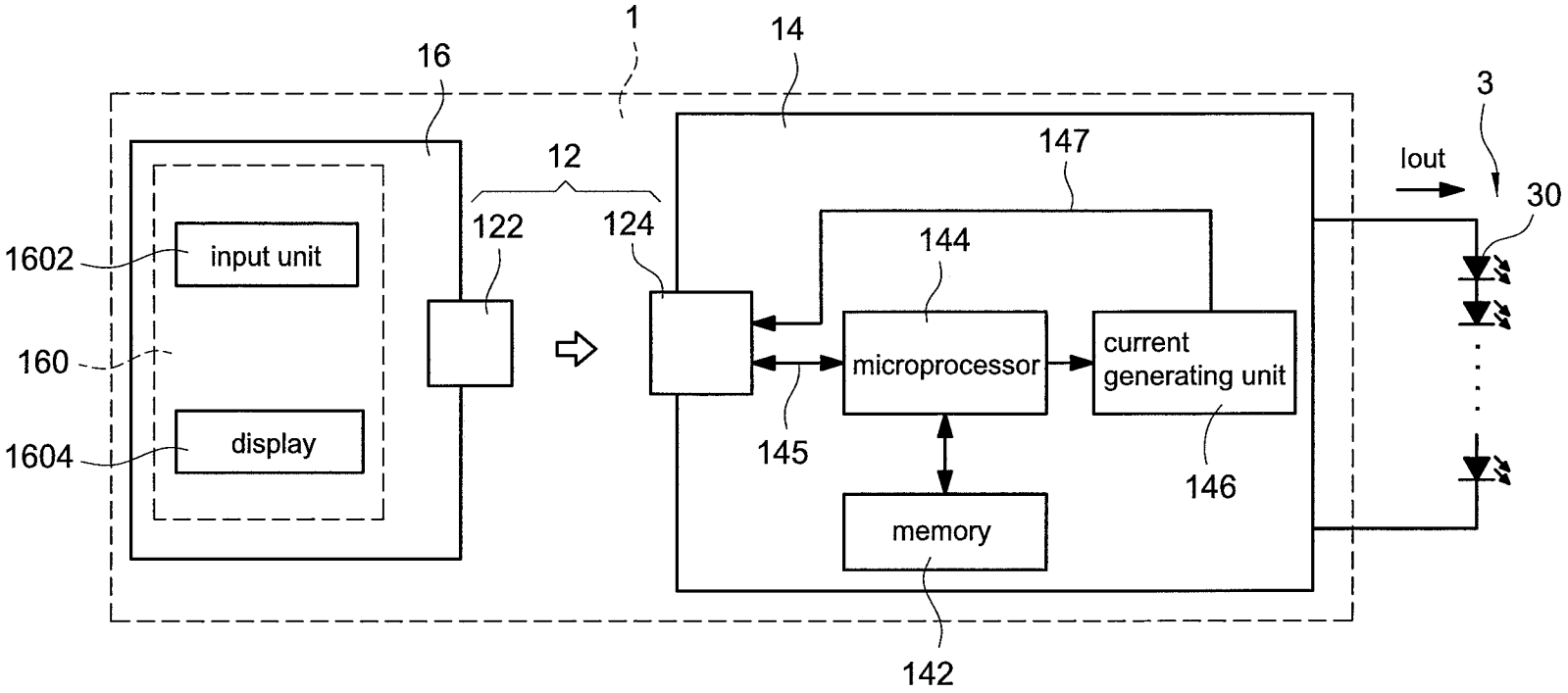
FIG. 6 is a circuit block diagram of a current adjustment apparatus for LED lighting fixture according to a 4th embodiment of the present disclosure.

Reference is made to FIG. 6, which is a circuit block diagram of a current adjustment apparatus for LED lighting fixture according to a 4th embodiment of the present disclosure. In FIG. 6, the current adjustment apparatus for LED lighting fixture 1 includes a communication interface 12, a current generating module 14, and a current adjustment module 16; the current generating module 14 is interconnected with the current adjustment module 16 by the communication interface 12 consolidating data transmissions and power delivery; the current generating module 14 and the current adjustment module 16 may be communicated with each other via the communication interface 12.

The communication interface 12 is a wire-based interface and may be a universal serial bus (USB) interface. The communication interface 12 includes a connector plug 122 and a mating port 124 configured to mate with the connector plug 122, and the mating of the connector plug 122 and the mating port 124 supports communications via a USB interface. In FIG. 6, the connector plug 122 is arranged on the current adjustment module 16, and the mating port 124 is arranged on the current generating module 14, the mating of the connector plug 122 and the mating port 124 provides a communication between the current adjustment module 16 and the current generating module 14. As used herein, mating the connector plug 122 with the mating port 124 refer to providing a physical connection.

The current generating module 14 includes a memory 142, a microprocessor 144, and a current generating unit 146; the memory 142 is electrically connected to the microprocessor 144 and configured to store a current setting parameter.

The microprocessor 144 is electrically connected to the memory 142 and the current generating unit 146; the microprocessor 144 is, for example, a pulse width modulator configured to modulate a duty cycle of a pulse width modulating (PWM) signal in response to the current setting parameter stored in the memory 142 or in accordance with a setting signal form the current adjustment module 16. More particular, the microprocessor 144 may modulate the duty cycle of the PWM signal in response to the current setting parameter form the memory 142 when the current generating module 14 is not physically connected to the current adjustment module 16; on the contrary, when the current generating module 14 is physically connected to the current adjustment module 16, the microprocessor 144 may modulate the duty cycle of the PWM signal in accordance with the setting signal form the current adjustment module 16.

The current generating unit 146 receives the PWM signal generated by the microprocessor 144 and generates a driving current Iout in accordance with the PWM signal. The LED lighting fixture 3 is connected to the current generating unit 146 for receiving the driving current Iout from the current generating unit 146.

The current adjustment module 16 is configured to generate the setting signal, a writing signal, and an erase signal and indicate a response signal from the current generating module 14. In FIG. 6, the current adjustment module 16 includes a user interface (UI) allows controlling operations of the current adjustment module 16 and is, for example, includes an input unit 1602 and a display 1604 with appropriate form for user.

The input unit 1602 may include appropriate component(s), such as buttons, keypad or the combination thereof, for providing user of the current adjustment module 16 to input controlling information (including, but not limited to, a setting signal, a writing signal, and an erase signal).

The display 1604 may include appropriate components for providing display functionality to the user of the current adjustment module 16, wherein the display 1604 may show information inputted by user or a response signal from the current generating module 14. Additionally, the current adjustment module 16 may be a touch-sensitive display consolidating input functionality providing by the input unit 1602 and display functionality providing by the display 1604, and user may input the setting signal, the writing signal, and the erase signal thereby.

When the current adjustment module 16 is physically connected to the current generating module 14 via the connector plug 122 and the mating port 124, the microprocessor 144 receives the setting signal from the current adjustment module 16 and modulates the duty cycle of the PWM signal in accordance with the setting signal, thus the level of the driving current Tout outputted from the current generating unit 146 is adjusted. It should be noted that the current generating module 14 may electrically connected to the mating port 124 via the path 147, hence when the current adjustment module 16 is physically connected to the current generating module 14, the current generating module 14 may supply an operation power to the current adjustment module 16 using USB power delivery protocol. In addition, the microprocessor 144 may receive the writing signal provided by the current adjustment module 16 when the current adjustment module 16 is physically connected to the current generating module 14 and communicate with the current generating module 14 via the USB interface; after the microprocessor 144 receives the writing signal, it overwrites the current setting parameter stored in the memory 142 in accordance with the setting signal to produce a new current setting parameter.

Furthermore, the microprocessor 144 may receive an erase signal provided by the current adjustment module 16 while the current adjustment module 16 is physically connected to the current generating module 14. After that, the microprocessor 144 modulates the duty cycle of the PWM signal in accordance with the setting signal from the current adjustment module 16 to adjust the level of the driving current Tout; in the meanwhile, the microprocessor 144 further erases the current setting parameter stored in the memory 142 to reset to a factory default. Thereafter, when the current adjustment module 16 is separated from the current generating module 14, the microprocessor 144 will modulate the duty cycle of the PWM signal in response to the factory default to adjust the level of the driving current Tout. It should be noted that the maximum level of the driving current Tout is occurred when current setting parameter is reset to the factory default.

The current adjustment apparatus for the LED lighting fixture 1 shown in FIG. 6 is mainly configured to overwrite the current setting parameter stored in the memory 142 in accordance with the setting signal or reset the current setting parameter to the factory default in accordance with the erase signal when the current generating module 14 is under powered on condition; however, in the practical application, the current adjustment apparatus for the LED lighting fixture 1 may overwrite the current setting parameter stored in the memory 142 in accordance with the setting signal or reset the current setting parameter to the factory default when the current generating module 14 is under powered off condition (namely providing an off-line burning functionality).

Figure 7:
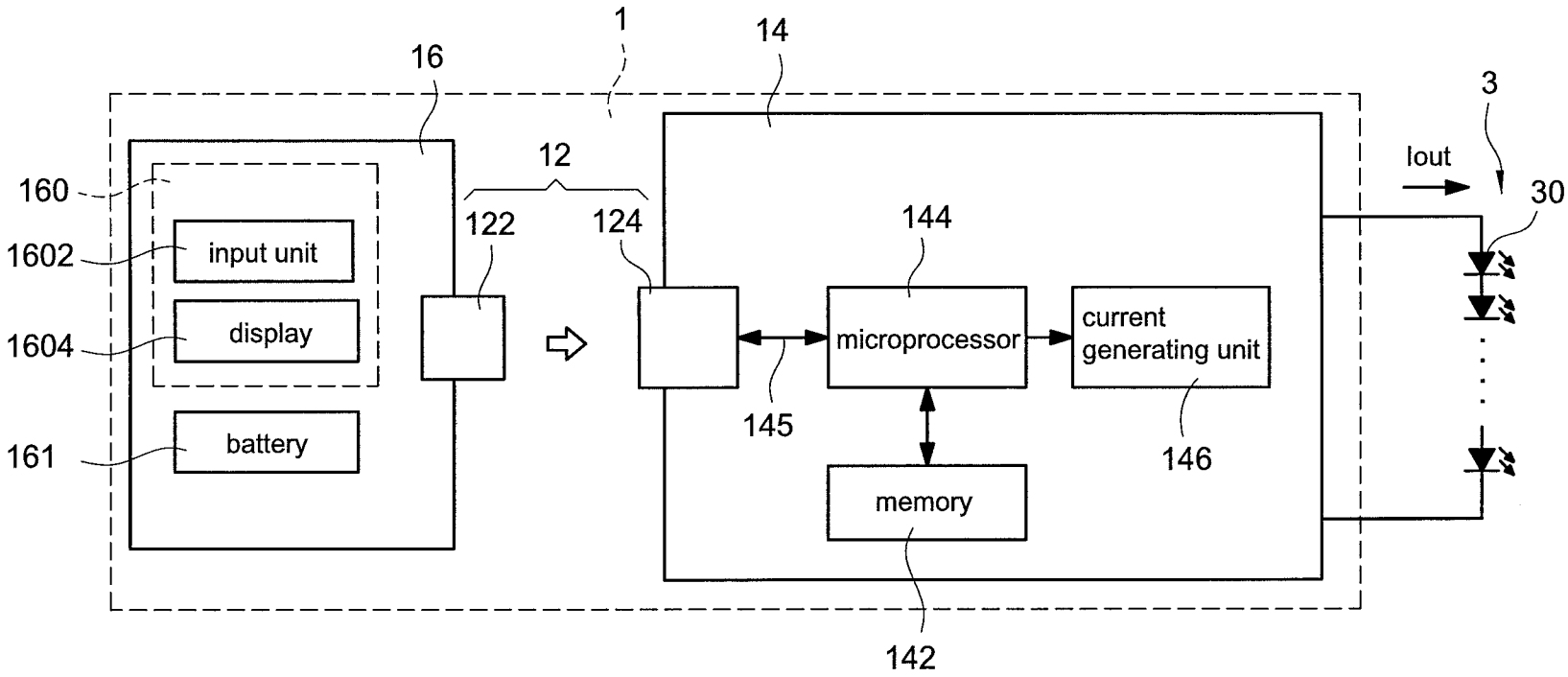
FIG. 7 is a circuit block diagram of a current adjustment apparatus for LED lighting fixture according to a 5th embodiment of the present disclosure.

Reference is made to FIG. 7, which is a circuit block diagram of a current adjustment apparatus for LED lighting fixture according to a 5th embodiment of the present disclosure. In FIG. 7, the current adjustment apparatus for LED lighting fixture 1 includes a communication interface 12, a current generating module 14, and a current adjustment module 16, and the scheme of the communication interface 12 and the current generating module 14 are the same as the communication interface 12 and the current generating module 14 shown in FIG. 6 mentioned above and is not repeated here for brevity.

The current adjustment module 16 includes a user interface (UI) 160 and a battery 161; the user interface 160 allows controlling operations of the current adjustment module 16 and, for example, includes an input unit 1602 and a display 1604. The battery 161 not only supplies an operation power to the user interface 160, but also supplies a DC power to the current generating module 14 using USB power delivery protocol.

Therefore, the input unit 1602 of the user interface 160 may generate the writing signal or the erase signal in accordance with a duration of the trigger instruction, the microprocessor 144 of the current generating module 14 may overwrite the current setting parameter stored in the memory 142 in accordance with the setting signal or reset the current setting parameter to the factory default in accordance with the erase signal, and the display 1604 of the current adjustment module 16 may display the response signal from the microprocessor 144.

Although the present disclosure has been described with reference to the foregoing preferred embodiment, it will be understood that the disclosure is not limited to the details thereof. Various equivalent variations and modifications can still occur to those skilled in this art in view of the teachings of the present disclosure. Thus, all such variations and equivalent modifications are also embraced within the scope of the disclosure as defined in the appended claims.

What is claimed is:

1. A current adjustment apparatus for light emitting diode (LED) lighting fixture, comprising:

a communication interface;

a current generating module comprising a microprocessor;

a memory electrically connected to the microprocessor and configured to store a current setting parameter; and a current generating unit electrically connected to the microprocessor and configured to generate a driving current for driving the LED lighting fixture; and a current adjustment module configured to generate a setting signal and a writing signal;

wherein the microprocessor makes the current generating unit generate the driving current with particular level in response to the current setting parameter when the current adjustment module is not physically connected to the current generating module;

the microprocessor makes the current generating unit generate the driving current with another particular level in accordance with the setting signal when the current generating module is physically connected to the current adjustment module and the microprocessor receives the setting signal via the communication interface; and the microprocessor further overwrites the current setting parameter in accordance with the setting signal when the microprocessor receives the writing signal via the communication interface.

2. The current adjustment apparatus for LED lighting fixture of claim 1, wherein the current adjustment module further generates an erase signal, and the microprocessor resets the current setting parameter to a factory default when the microprocessor receives the erase signal via the communication interface.

3. The current adjustment apparatus for LED lighting fixture of claim 2, wherein the current adjustment module includes a user interface for generating the setting signal, the writing signal, and the erase signal.

4. The current adjustment apparatus for LED lighting fixture of claim 3, wherein the microprocessor generates a response signal when the current setting parameter is successfully overwritten in accordance with the setting signal, and the response signal is transmitted to the user interface via the communication interface and displayed by the user interface.

5. The current adjustment apparatus for LED lighting fixture of claim 4, wherein the current adjustment module further comprises a battery for supplying an operation power to the user interface, the microprocessor, and the memory.

6. The current adjustment apparatus for LED lighting fixture of claim 5, wherein the communication interface conducts the operation power using a universal serial bus (USB) power delivery protocol.

7. The current adjustment apparatus for LED lighting fixture of claim 4, wherein the current generating module supplies an operation power to the current adjustment module via the communication interface.

8. The current adjustment apparatus for LED lighting fixture of claim 2, wherein the current adjustment module comprising:

a setting signal generator configured to generate the setting signal; and a write-erase unit electrically connected to the setting signal generator and configured to generate the writing signal and the erase signal in accordance with a trigger instruction.

9. The current adjustment apparatus for LED lighting fixture of claim 8, wherein the write-erase unit generates the writing signal when a duration of the trigger instruction continues for a first predetermined time length, and the write-erase unit generates the erase signal when the duration of the trigger instruction exceeds a second predetermined time length, the second predetermined time length is longer than the first predetermined time length.

10. The current adjustment apparatus for LED lighting fixture of claim 8, wherein the current adjustment module further comprises an indicator configured to indicate a response signal generated by the microprocessor when the current setting parameter is successfully overwritten in accordance with the setting signal, and the response signal is transmitted from the microprocessor to the current adjustment module via the communication interface.

11. The current adjustment apparatus for LED lighting fixture of claim 10, wherein the current generating module supplies an operation power to the current adjustment module via the communication interface.

12. The current adjustment apparatus for LED lighting fixture of claim 11, wherein the communication interface conducts the operation power using a universal serial bus (USB) power delivery protocol.

13. The current adjustment apparatus for LED lighting fixture of claim 10, further comprises a power supply physically connected to the current adjustment module and configured to supply an operation power to the current adjustment module, the microprocessor, and the memory.

14. The current adjustment apparatus for LED lighting fixture of claim 13, wherein the communication interface conducts the operation power using a universal serial bus (USB) power delivery protocol.

* * * * *